US009909832B2

(12) United States Patent
Darlington et al.

(10) Patent No.: US 9,909,832 B2
(45) Date of Patent: Mar. 6, 2018

(54) DRY-FIRE SAFETY FOR CROSSBOW

(71) Applicant: Rex F. Darlington, Whittemore, MI (US)

(72) Inventors: Rex F. Darlington, Whittemore, MI (US); David P. McNeil, II, Howard City, MI (US)

( * ) Notice: Subject to any disclaimer, the term of this patent is extended or adjusted under 35 U.S.C. 154(b) by 214 days.

(21) Appl. No.: 14/142,345

(22) Filed: Dec. 27, 2013

(65) Prior Publication Data

US 2014/0182574 A1 Jul. 3, 2014

Related U.S. Application Data

(60) Provisional application No. 61/746,954, filed on Dec. 28, 2012, provisional application No. 61/762,392, filed on Feb. 8, 2013.

(51) Int. Cl.

| | |
|---|---|
| ***F41B 5/12*** | (2006.01) |
| ***F41A 19/10*** | (2006.01) |
| ***F41A 17/56*** | (2006.01) |
| ***F41A 19/12*** | (2006.01) |

(52) U.S. Cl.

CPC ..... *F41B 5/12* (2013.01); *F41A 17/56* (2013.01); *F41A 19/10* (2013.01); *F41A 19/12* (2013.01)

(58) Field of Classification Search

CPC ..... F41B 5/12; F41B 5/1469; F41B 3/005; F41A 19/10; F41A 19/12; F41A 17/46; F41A 17/56

See application file for complete search history.

(56) References Cited

U.S. PATENT DOCUMENTS

| | | | | |
|---|---|---|---|---|
| 5,085,200 | A * | 2/1992 | Horton-Corcoran | F41B 5/1469 124/25 |
| 5,598,829 | A | 2/1997 | Bednar | |
| 6,205,990 | B1 | 3/2001 | Adkins | |
| 6,736,123 | B1 | 5/2004 | Summers et al. | |
| 7,770,567 | B1 | 8/2010 | Yehle | |
| 8,375,928 | B1 | 2/2013 | Bednar et al. | |
| 8,522,761 | B1 | 9/2013 | Chu | |
| 8,578,917 | B2 | 11/2013 | Bednar et al. | |
| 2011/0253118 | A1 | 10/2011 | Kempf | |

* cited by examiner

*Primary Examiner* — Melba Bumgarner
*Assistant Examiner* — Amir Klayman
(74) *Attorney, Agent, or Firm* — Reising Ethington, P.C.

(57) ABSTRACT

A trigger mechanism for a crossbow that includes a housing having a channel for receiving an arrow, a trigger arm carried by the housing, a bowstring latch for retaining a bowstring in a cocked position that is pivotally carried by the housing and engagable with the trigger arm, and a dry-fire safety (DFS) latch pivotally carried by the housing and engagable with the bowstring latch, wherein the DFS latch substantially retains the bowstring latch in the cocked position when the trigger arm is actuated without the arrow seated in the channel.

17 Claims, 8 Drawing Sheets

DRY-FIRE SAFETY FOR CROSSBOW

This application claims priority from U.S. provisional patent application 61/746,954 filed Dec. 28, 2012 and U.S. provisional patent application 61/762,392 filed Feb. 8, 2013.

TECHNICAL FIELD

The present disclosure is directed to crossbows, and more particularly, to dry-fire safety mechanisms on crossbows.

BACKGROUND AND SUMMARY OF THE DISCLOSURE

A crossbow drawstring is typically drawn into a firing or trigger mechanism of the crossbow prior to inserting an arrow. The trigger mechanism may be capable of holding and retaining the drawstring for long periods of time (e.g., with or without an arrow in place). A problem can arise when the crossbow is fired without an arrow (e.g., dry-fired). In some instances, dry-firing may result in damage to the crossbow and/or injury to the user.

A general object of the present disclosure is to provide a crossbow having a dry-fire safety (DFS) mechanism.

The present disclosure embodies a number of aspects that can be implemented separately from or in combination with each other.

In accordance with one aspect of the present disclosure, there is provided a trigger mechanism for a crossbow that includes a housing having a channel for receiving an arrow, a trigger arm carried by the housing, a bowstring latch for retaining a bowstring in a cocked position that is pivotally carried by the housing and engagable with the trigger arm, and a dry-fire safety (DFS) latch pivotally carried by the housing and engagable with the bowstring latch, wherein the DFS latch substantially retains the bowstring latch in the cocked position when the trigger arm is actuated without the arrow seated in the channel.

In accordance with another aspect of the present disclosure, there is provided a trigger mechanism for a crossbow that includes a housing having a channel for receiving an arrow, a trigger arm carried by the housing and having a plurality of fingers, a bowstring latch for retaining a bowstring, and that is pivotally carried by the housing and movably engagable with one finger of the trigger arm, and a dry-fire safety (DFS) latch pivotally carried by the housing and extending into the channel and configured to inhibit bowstring release when the bowstring latch is in the cocked position and when the trigger arm is actuated by dry-firing.

In accordance with another aspect of the present disclosure, there is provided a trigger mechanism for a crossbow that includes a housing having a channel for receiving an arrow, a trigger arm carried by the housing, a bowstring latch for retaining a bowstring, and that is pivotally carried by the housing and movably engagable with the trigger arm, and a dry-fire safety (DFS) latch pivotally carried by the housing and extending into the channel and configured to inhibit bowstring release when the bowstring latch is in the cocked position and the trigger arm is actuated by dry-firing.

In accordance with another aspect of the present disclosure, there is provided a safety mechanism for a crossbow that includes a trigger linkage extending from a housing carrying and coupled to a trigger mechanism, wherein a distal end of the linkage includes a safety detent pin and a safety stop pin both extending therefrom, and a rotatable spool having an outer surface that includes a first pocket, a second pocket in communication with the first pocket, and a hole, wherein the spool is coupled to the trigger linkage by the coupling of the detent pin and the first and second pockets and by the coupling and decoupling of the stop pin and the hole, wherein rotation of the spool with respect to the trigger linkage places the safety mechanism in a safe mode or a fire mode.

BRIEF DESCRIPTION OF THE DRAWINGS

The disclosure, together with additional objects, feature, advantages and aspects thereof, will best be understood from the following description, the appended claims and the accompanying drawings, in which:

DETAILED DESCRIPTION

Figure 1:
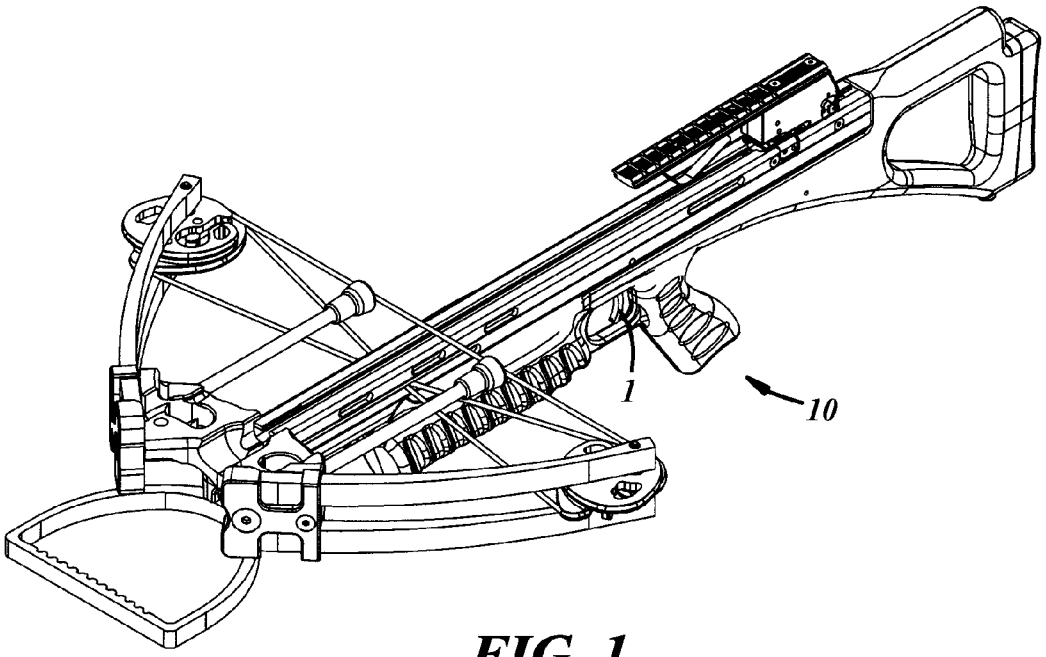
FIG. 1 is a perspective view of a crossbow according to a first illustrative embodiment.
Figure 2:
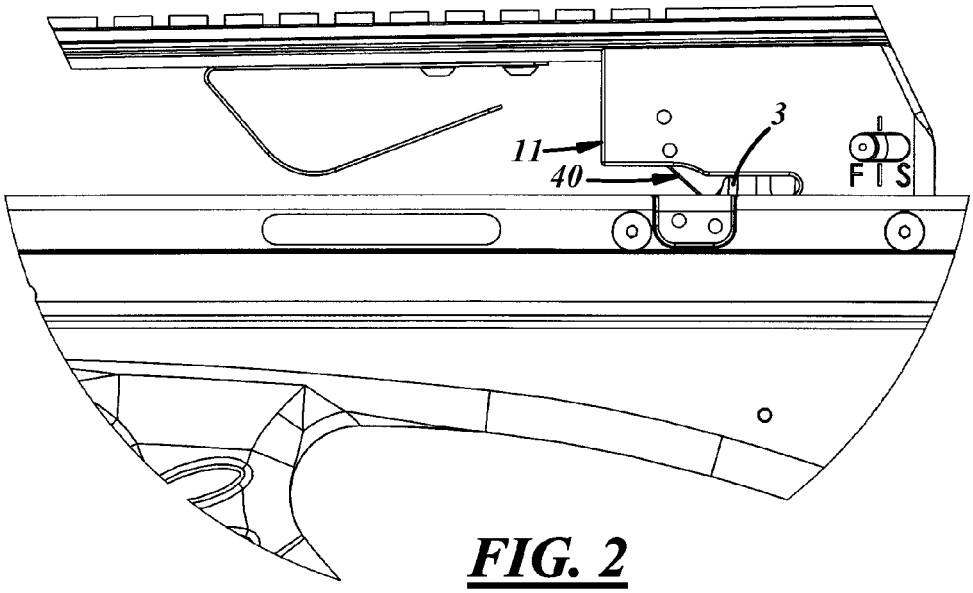
FIG. 2 is a fragmentary, side elevational view of a portion of the crossbow of FIG. 1.

FIGS. 1 and 2 illustrate a crossbow 10 having a trigger 1 coupled to a dry-fire safety (DFS) latch or anchor or mechanism 40 that inhibits a bowstring latch 3 from releasing a bowstring 7 if no arrow 8 is present (see also FIGS. 2-6). Other crossbow dry-fire/safety designs, such as that disclosed in U.S. Pat. No. 5,598,829, include a safety member that may become caught in the bowstring if the crossbow is fired without an arrow. In these designs repeated use and/or dry-firings may damage the crossbow and/or sever the bowstring and potentially injure the user. At least in part, this is due to the fact that a dry-fire safety member physically catches the retracting or releasing bowstring as the bowstring retracts under the force of the crossbow's limbs. For example, contact with the bowstring momentarily may be lost—e.g., as the bowstring releases from a bowstring latch to the safety member. In the present disclosure, the bowstring does not release, and thus the present disclosure does not 'catch' the bowstring. This provides greater crossbow durability and user safety.

FIGS. 2-6 illustrate a trigger box assembly 11 that includes a trigger mechanism 34 carried by the crossbow 10. More specifically, the trigger mechanism 34 includes a housing 36 having a channel 38 for receiving the arrow 8. As best shown in FIGS. 3-6, the housing 36 may carry the DFS latch 40, the bowstring latch 3, a trigger arm 4, and a safety mechanism 6. In general, the DFS latch 40 is a rotating component having a portion located in the arrow path or channel 38 and biased to lock the bowstring latch 3 in place from above the latch 3 until the arrow 8 is inserted into the channel 38 to displace the DFS latch 40. Accordingly, the DFS latch 40 automatically engages the bowstring latch 3 when the arrow 8 is not in the channel 38 or is being removed from the channel 38 to prevent accidental or dry fire release of the bowstring 7.

In the embodiment shown in FIGS. 3-6, the DFS latch 40 is pivotably carried by an axle 42 and has a first end 44 which rotatably may extend into the channel 38 and a second, opposing end 46. The rotation of the DFS latch 40 may be limited according to a stop or stop pin 9 (also coupled to the housing 36) which may contact the second end 46. In addition, the DFS latch 40 may be coupled to a biasing spring 2 (e.g., between its first end 44 and the axle 42). The biasing spring 2 may be coupled to the housing 36 and configured to apply a force on the first end 44—e.g., to drive the first end 44 into or towards the channel 38.

The bowstring latch 3 may be rotatably carried by the housing 36 by an axle 49 between a first end 50 and a second, opposing end 52. The first end 50 may extend into the channel 38, enabling the latch 3 to retain the bowstring 7 in a cocked position (e.g., against a rearward-facing side 64 of the latch 3); and the second end may extend in the opposite direction towards the trigger arm 4.

The trigger arm 4 may be carried in the housing 36 via an axle 54 and may have three radially outwardly extending fingers: a first finger 56 extending toward (and engageable/disengageable with) the rearward-facing side 64 of the second end 52 of the bowstring latch 3, a second finger 58 extending outwardly from the housing 36 (e.g., to directly or indirectly coupleable with the trigger 1), and a third finger 60 extending in opposite direction with respect to the first finger 56. In some implementations, the second finger 58 may be the trigger 1. In addition, the second finger 58 may be coupled to a biasing spring 5 (which also may be coupled to the housing 36) which applies a force biasing the trigger arm 4 to a ready-to-fire position (e.g., FIGS. 3-5), but wherein the second finger 58 is limited by a stop or stop pin 61. Also, a distal end 63 of the third finger 60 may be positioned to suitably engage/disengage the safety mechanism 6.

Figure 3:
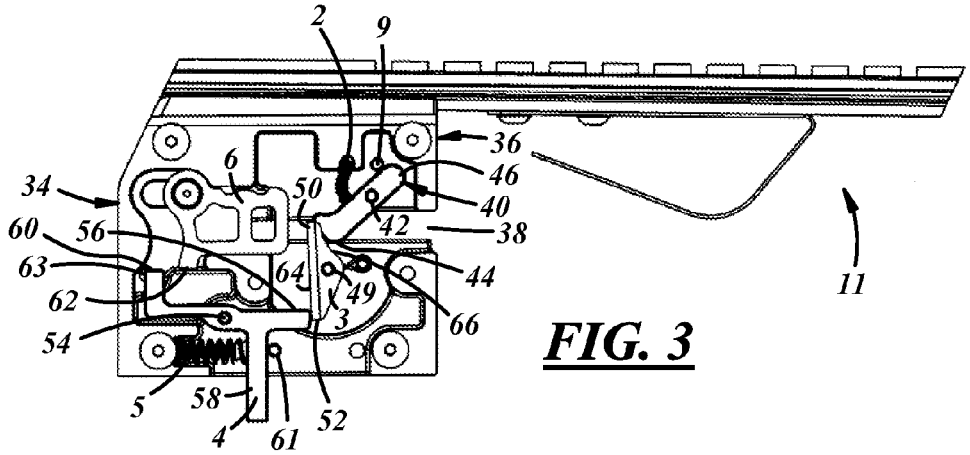
FIG. 3 is an internal, side elevational view of a trigger box of the crossbow of FIG. 1.
Figure 4:
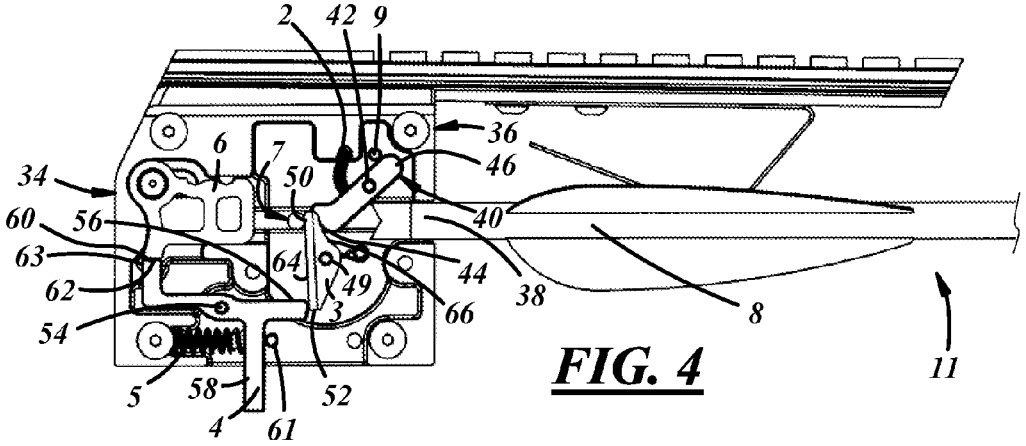
FIG. 4 is another internal, side elevational view of the trigger box of FIG. 1.
Figure 5:
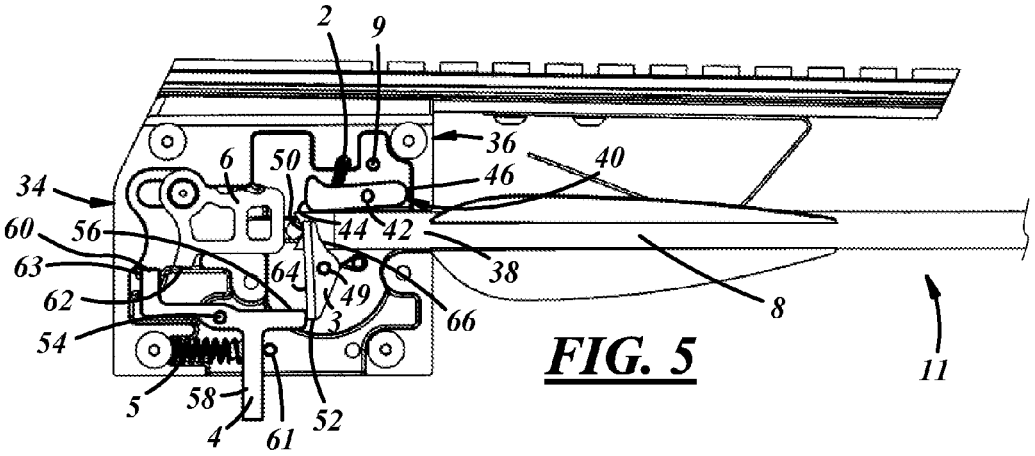
FIG. 5 is another internal, side elevational view of the trigger box of FIG. 1.
Figure 6:
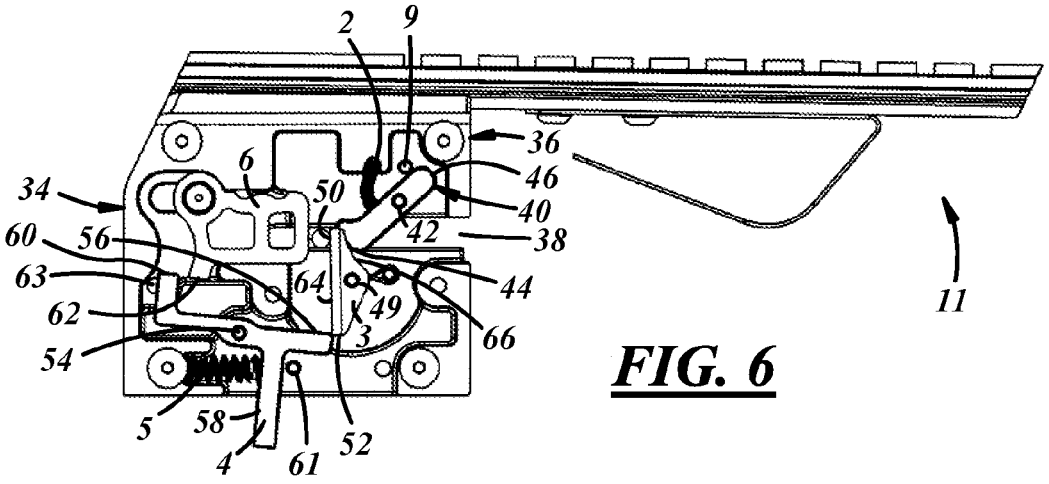
FIG. 6 is another internal, side elevational view of the trigger box of FIG. 1.
Figure 7:
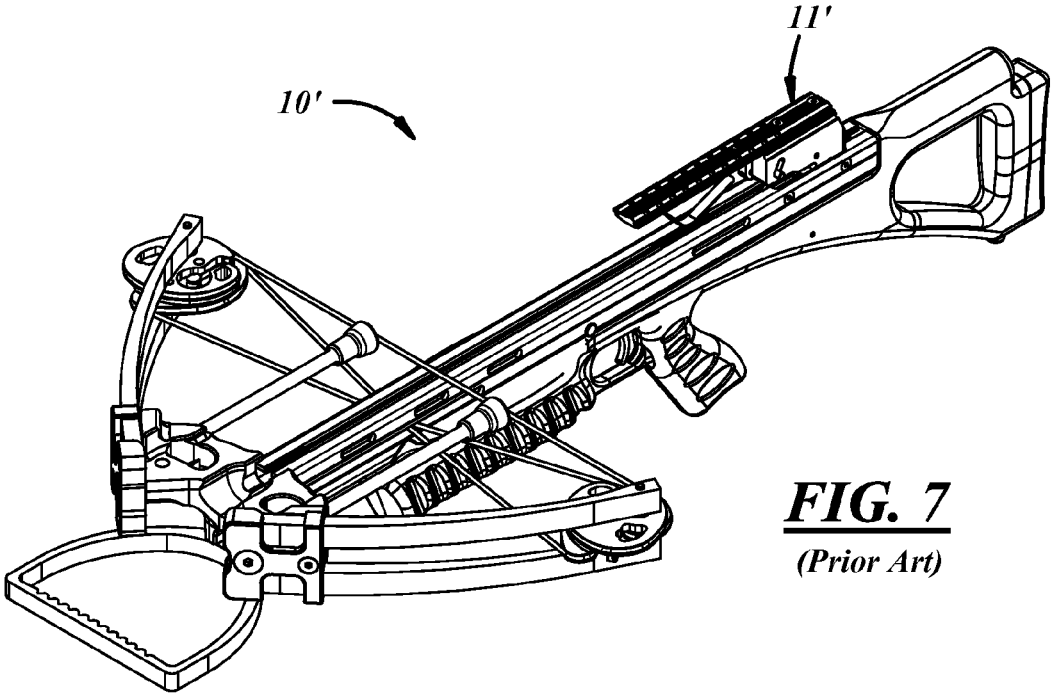
FIG. 7 (Prior Art)
FIG. 7 is a perspective view of a crossbow according to the prior art.
Figure 8:
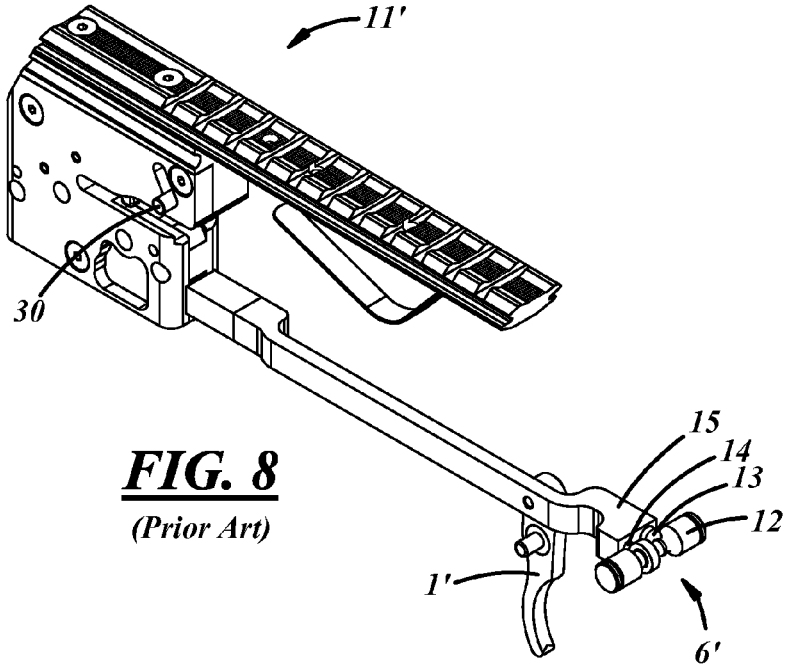
FIG. 8 (Prior Art)
FIG. 8 is a perspective view of a trigger box and a safety mechanism of the crossbow of FIG. 7.

In FIGS. 3-6, the safety mechanism 6 may be slidable within the housing 36 from a safe position or mode to a fire position or mode (e.g., in FIG. 4, the safety mechanism 6 is shown in the safe mode, and in FIGS. 3, 5, and 6, the safety mechanism 6 is shown in the fire mode). In the fire mode, the third finger 60 has clearance to move—and thus the trigger arm 4 is rotatable about the axle 54; however, in the safe mode, a foot 62 on the safety mechanism 6 contacts the distal end 63 of the third finger 60 thereby inhibiting rotation of the trigger arm 4.

In operation, while in the fire mode, the user of the crossbow 10 may draw the bowstring 7 into the channel 38 beyond the DFS latch 40 and the bowstring latch 3 into a fully cocked mode. In some instances, the drawing of the bowstring 7 may move the safety mechanism 6 into the safe mode (e.g., in a single motion). Thereafter, the user may release the bowstring 7 and tension on the bowstring 7 may seat the bowstring 7 against the first end 50 of the bowstring latch 3. In addition as illustrated in FIG. 4, without the arrow 8 in the channel 38, the first end 44 of the DFS latch 40 may engage the first end 50 of the bowstring latch 3 (i.e., on a frontward-facing side 66).

If, following this operation, the crossbow 10 is dry-fired, the bowstring 7 will not be released, as shown in FIG. 6. Instead, the crossbow 10 may be in a partially cocked mode. The term dry-firing may include any instance of actuating the trigger arm 4 without the arrow 8 being properly seated in the channel 38, including purposely or accidentally pulling the trigger 1 without the arrow 8 in place.

In FIG. 6, the safety mechanism 6 is in the fire mode and the first finger 56 of the trigger arm 4 is no longer contacting the rearward-facing side 64 (e.g., at the second end 52) of the bowstring latch 3—e.g., having been actuated by the trigger 1. The bowstring 7 either may not move or may not move substantially from its previous fully cocked position. This is due to the bowstring 7 applying a force on the rearward-facing side 64 at the first end 50 (of the bowstring latch 3) and the DFS latch 40 applying an equal and at least nearly opposing force on the forward-facing side 66 of the first end 50 (of the bowstring latch 3) since the rotational travel of the DFS latch 40 is limited by the stop pin 9. As used herein, not moving substantially (or nonsubstantial or marginal movement) of the bowstring 7 and/or the bowstring latch 3 in the channel 38 between the fully cocked and partially cocked modes includes lateral movement less than or equal to 1/16 of an inch (and correspondingly, substantially retaining, holding, grasping, keeping, detaining, or maintaining the position of the bowstring 7 and/or bowstring latch 3 includes lateral movement less than or equal to 1/16 of an inch).

In the partially cocked mode, the bowstring 7 may have minimal tension. Re-cocking of the crossbow in this position is relatively easy because the bowstring has moved less than 1/16 of an inch from its fully cocked position and there isn't very much tension on the bowstring at this point. In addition, after being dry-fired, the crossbow 10 may be unusable until it is again placed into the fully cocked mode by drawing or pulling back on the bowstring 7 again. Re-drawing the bowstring 7 may enable the trigger 1 and trigger arm 4 to be reset (e.g., re-locating the first finger 56 against the rearward-facing side 64 of the bowstring latch 3). In addition, in at least some embodiments, re-drawing the bowstring 7 may also re-position the safety mechanism 6 in the safe mode, as previously described.

When the crossbow 10 is in the fully cocked mode, the arrow 8 may be inserted into the channel 38, as shown in FIGS. 4 and 5. In a fully cocked and loaded mode shown in FIG. 5, the crossbow is ready to fire once the safety mechanism 6 is moved to the fire mode. In the fully cocked and loaded mode, the arrow 8 rotatably has displaced the first end 44 of the DFS latch 40 out of the channel 38; i.e., when the arrow was positioned in the channel 38. This displacement consequently compresses the biasing spring 2, biasing first end 44 of the DFS latch 40 to again move towards the channel 38 once the arrow 8 is fired.

When the crossbow 10 is fired from the fully cocked and loaded mode, the first finger 56 of the trigger arm 4 disengages the rearward-facing side 64 of the second end 52 of the bowstring latch 3, and the latch 3 rotates to release the bowstring 7. Since the DFS latch 40 is no longer in contact with the first end 50 of the bowstring latch 3, the bowstring 7 releases firing the arrow 8. In addition, the since the DFS latch 40 is no longer extending into the channel 38, the DFS latch 40 does not inhibit the travel of the bowstring 7.

FIGS. 7-12 illustrate an embodiment of a prior art crossbow 10' having a trigger box assembly 11' and a safety mechanism 6', and FIGS. 13-22 illustrate an embodiment of crossbow 10" according to the present disclosure having a trigger box assembly 11" and a safety mechanism 6". In FIGS. 7-22, elements similar in function to those described above in connection with FIGS. 1-6 are indicated by correspondingly identical/similar reference numerals.

Figure 9:
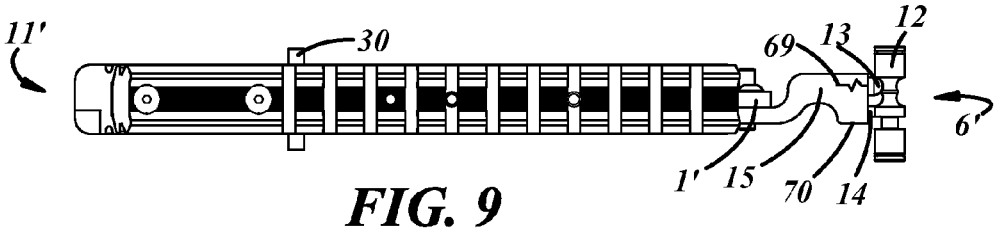
FIG. 9 (Prior Art)
FIG. 9 is a top view of the trigger box and the safety mechanism of FIG. 8 in a safe position.
Figure 10:
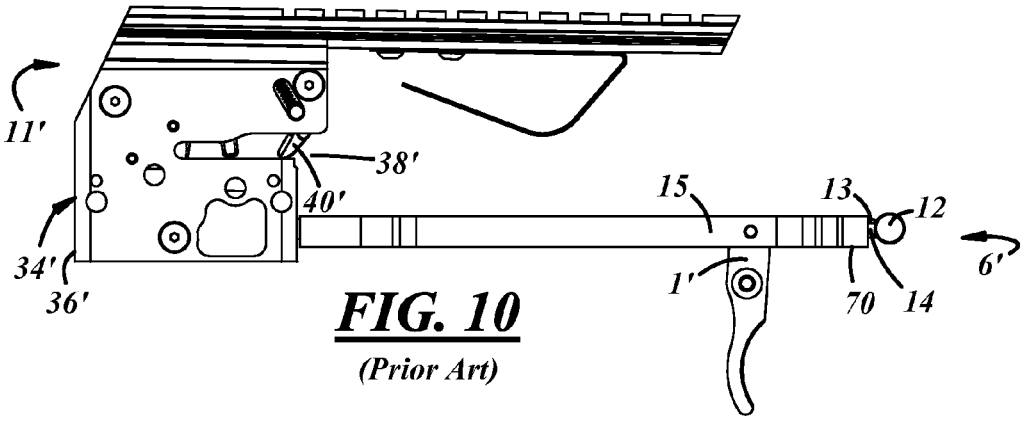
FIG. 10 (Prior Art)
FIG. 10 is a side, elevational view of the trigger box and the safety mechanism of FIG. 8 in the safe position.
Figure 11:
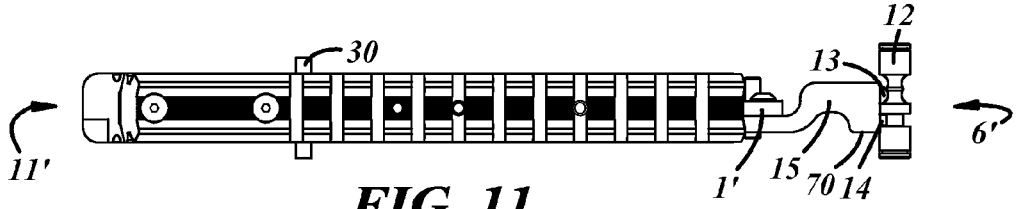
FIG. 11 (Prior Art)
FIG. 11 is a top view of the trigger box and the safety mechanism of FIG. 8 in a fire position.
Figure 12:
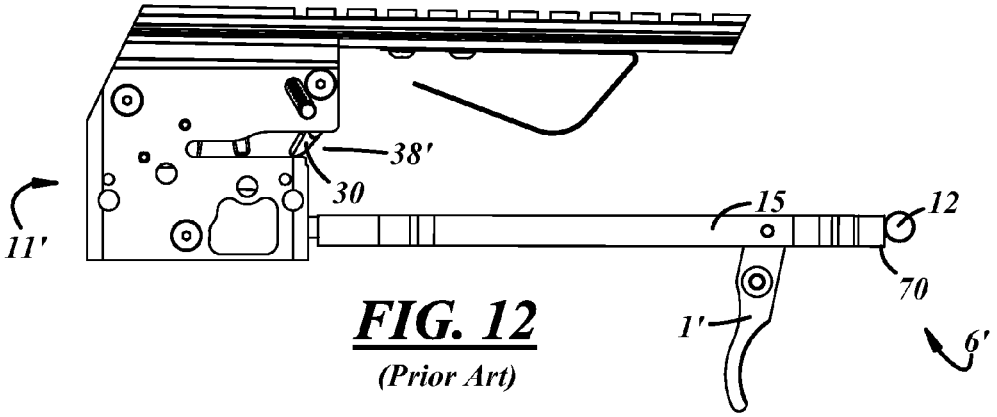
FIG. 12 (Prior Art)
FIG. 12 is a side, elevational view of the trigger box and the safety mechanism of FIG. 8 in the fire position.
Figure 13:
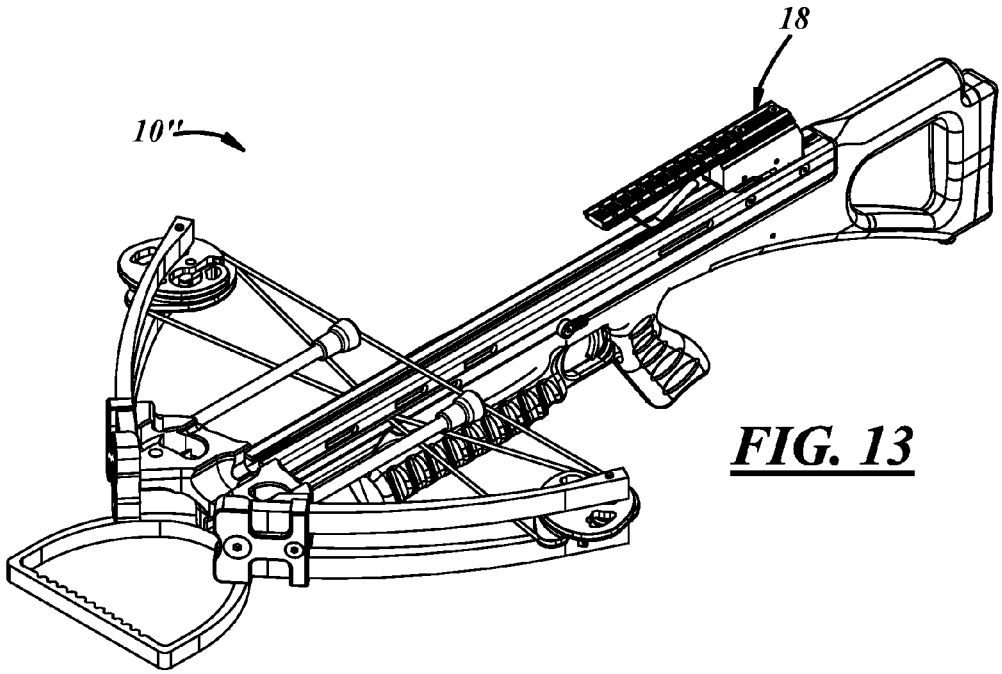
FIG. 13 is a perspective view of a crossbow according to a second illustrative embodiment.
Figure 14:
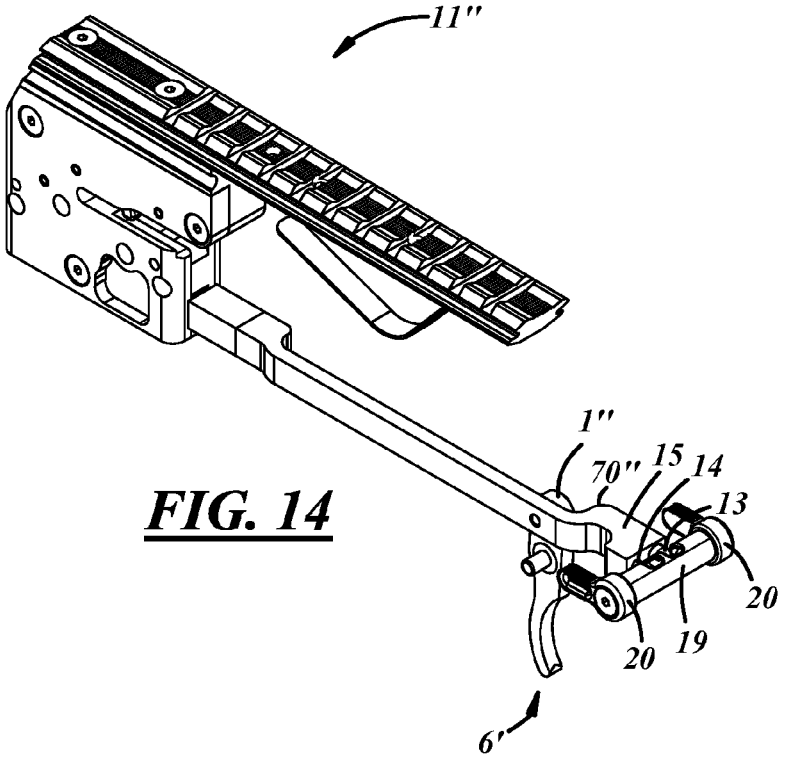
FIG. 14 is a perspective view of a trigger box and a safety mechanism of the crossbow of FIG. 13.
Figure 15:
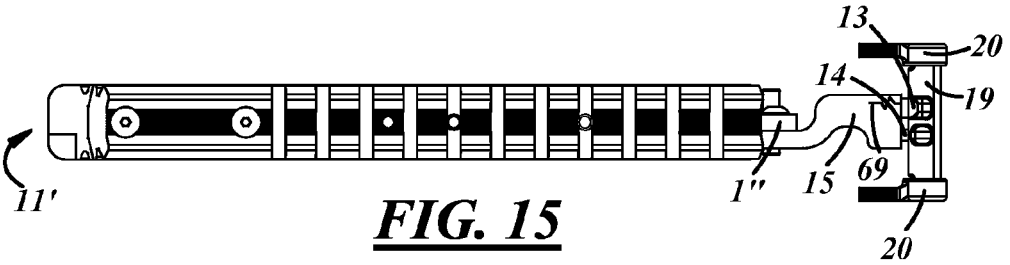
FIG. 15 is a top view of the trigger box and the safety mechanism of FIG. 14 in a safe position.
Figure 16:
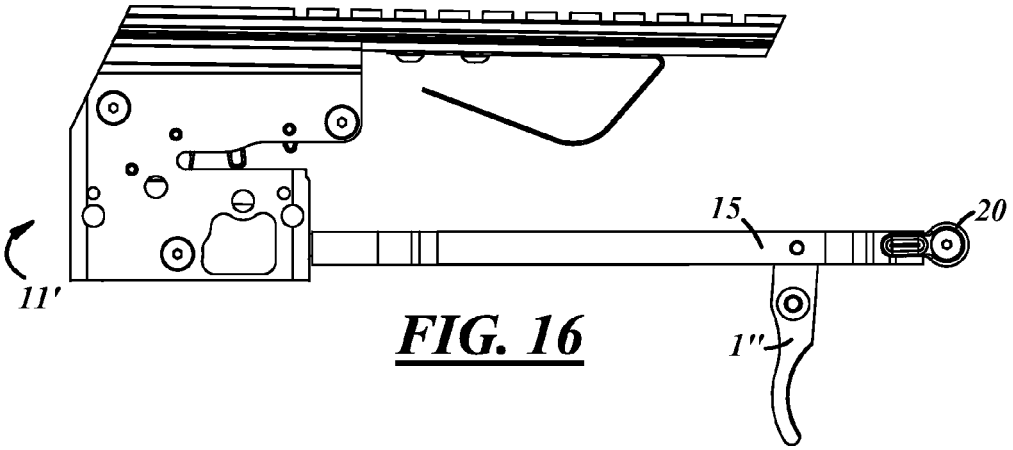
FIG. 16 is a side, elevational view of the trigger box and the safety mechanism of FIG. 14 in the safe position.
Figure 17:
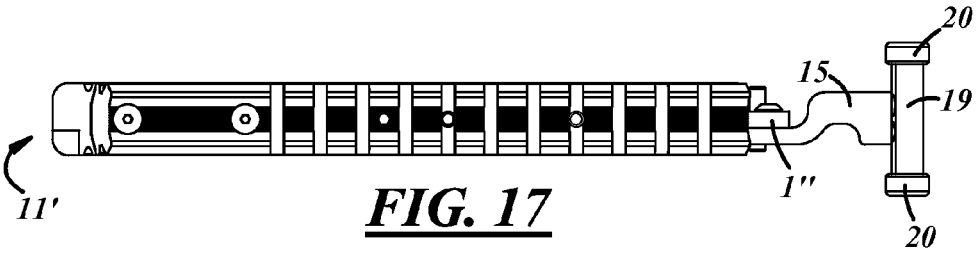
FIG. 17 is a top view of the trigger box and the safety mechanism of FIG. 14 in a fire position.
Figure 18:
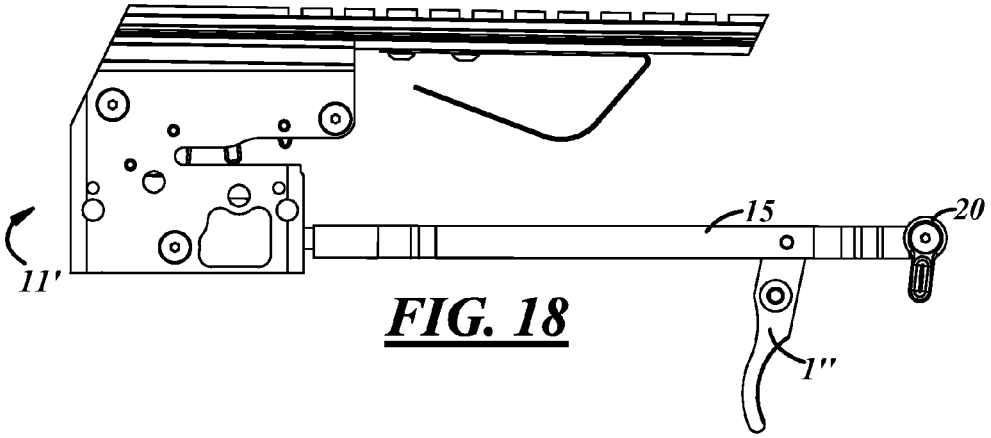
FIG. 18 is a side, elevational view of the trigger box and the safety mechanism of FIG. 14 in the fire position.

As best shown in FIGS. 8-12, the trigger box assembly 11' includes a trigger mechanism 34' having a housing 36'. A trigger linkage 15 extends from the trigger mechanism 34' having a trigger 1' and the safety mechanism 6' at a distal end 70 of the linkage 15. The safety mechanism 6' includes a safety slide 12 having a linkage safety stop pin 14 and extends from a safety slide detent pin 13 biased by a spring 69 (shown in phantom) which is coupled to the linkage 15. (FIGS. 9-10 illustrate a safe position or mode, and FIGS. 11-12 illustrate a fire position or mode.)

The trigger mechanism 34' may be a conventional bowstring 'catch' type. Thus, in the event the crossbow 10' is dry-fired, the bowstring 7 may displace laterally within a channel 38' and be physically 'caught' by the DFS latch 40'.

Turning to FIGS. 13-22, as in the prior art implementation, the safety mechanism 6" of crossbow 10" is located at a distal end 70" of the trigger linkage 15. The safety mechanism 6" includes a rotatable safety spool 19. In general, the spool 19 is rotatable, instead of being laterally or side-to-side slidable, and is quieter and easier to operate than the prior art safety. The spool 19 includes a first detent groove or pocket 27 (associated with a fire mode or safety OFF), a second detent groove or pocket 28 (associated with a safe mode or safety ON), and a stop pin hole 29 (see FIG. 22). The first and second grooves 27, 28 may include any depression, dimple, indentation, cavity, hole, notch, etc. In at least one embodiment, the first groove 27 may be deeper than the second groove 28. The spool 19 may be at least partially hollow having a cavity 74 through which an axis 76 extends between a first end 78 and a second end 80. The grooves 27, 28 extend inwardly to the cavity 74 and may be sized to receive the detent pin 13 (coupled to spring 69) at the distal end 70" of the trigger linkage 15. The first and second grooves 27, 28 may be adjacent to one another defining an opening 82 on an outer surface 84 of the spool 19. And the hole 29 also may extend inwardly to the cavity 74 defined by opening 85 and may be sized to receive the safety stop pin 14 when the spool 19 is rotated. The hole 29 may be located on the same side 86 of the outer surface 84 as the first groove 27—e.g., spaced between the first groove 27 and the first end 78. The first and second ends 78, 80 each may have a safety latch 88 extending radially outwardly therefrom to facilitate rotation of the spool 19 to thereby move the trigger mechanism 34" between the fire and safe modes. In at least some embodiments, the latches 88 may be located proximately to the trigger 1".

In operation, the latches 88 may be rotated (e.g., within a range of 0-90°) correspondingly rotating the spool 19. In the safe mode (FIGS. 15-16), the safety latches 88 may be positioned upwardly, the first groove 27 and the hole 29 may face upwardly, and the spool 19 may be spaced from the linkage 15. In this mode, the safety stop pin 14 may be disengaged from the hole 29 (e.g., contacting the outer surface 84 of the spool), and the detent pin 13 may be positioned within the second groove 28. When the safety latches 88 are rotated to the fire mode (facing downwardly) (FIGS. 17-18), the detent pin 13 may move from the second groove 28 to the first groove 27 and the safety stop pin 14 may locate within the hole 29. The stop pin 14 may locate within the hole 29, at least in part, due to the detent pin 13 entering the deeper, first groove 27. When the stop pin 14 is located in the hole 29, the travel of the linkage 15 may be limited, thereby inhibiting trigger 1" actuation.

Figure 19:
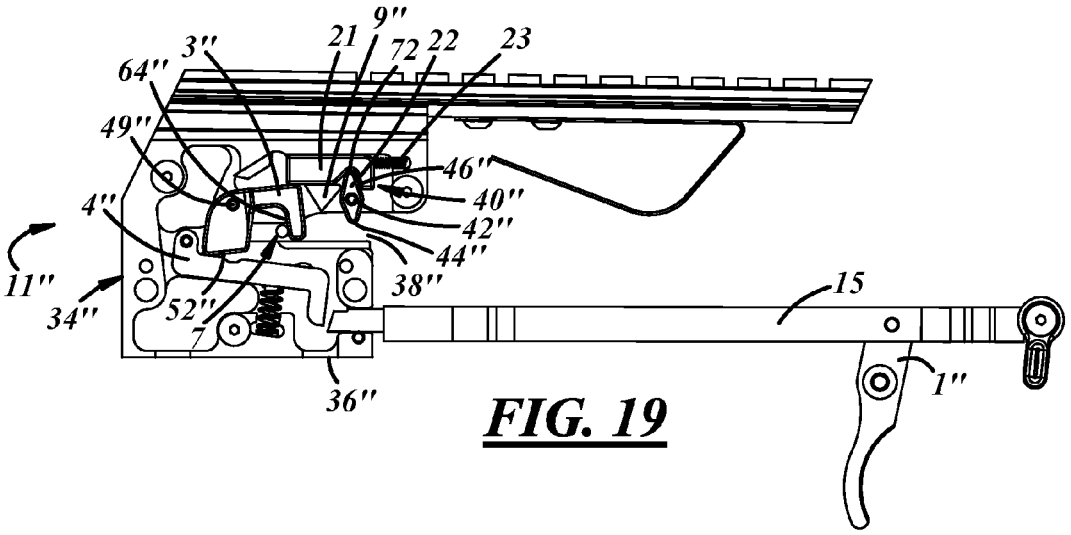
FIG. 19 is an internal, side elevational view of the trigger box and the safety mechanism of FIG. 14 in the fire position.
Figure 20:
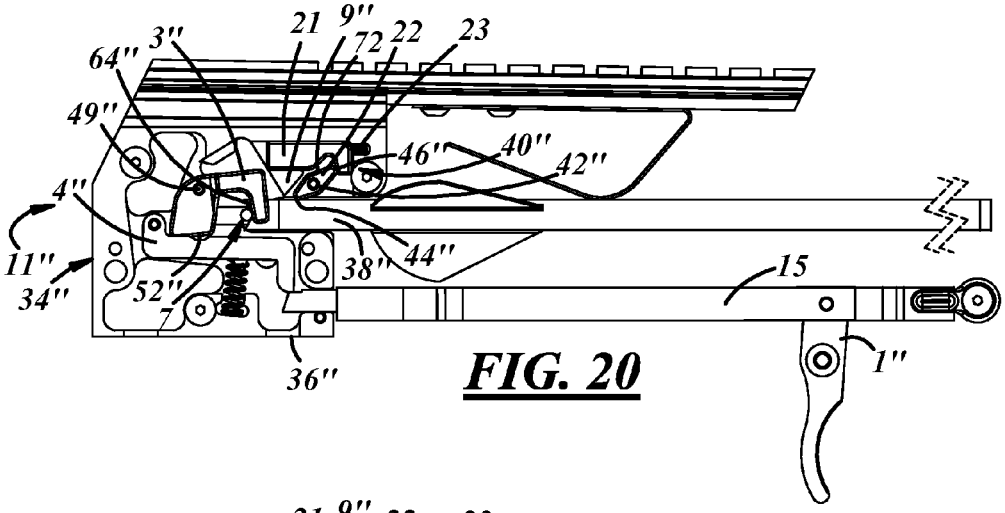
FIG. 20 is another internal, side elevational view of the trigger box and the safety mechanism of FIG. 14 in a cocked position.
Figure 21:
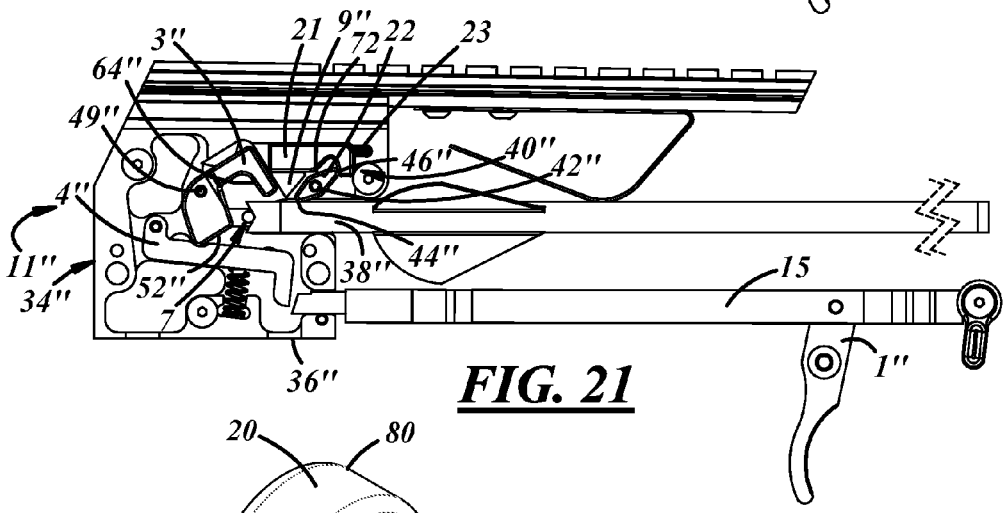
FIG. 21 is another internal, side elevational view of the trigger box and the safety mechanism of FIG. 14 in a fired position.
Figure 22:
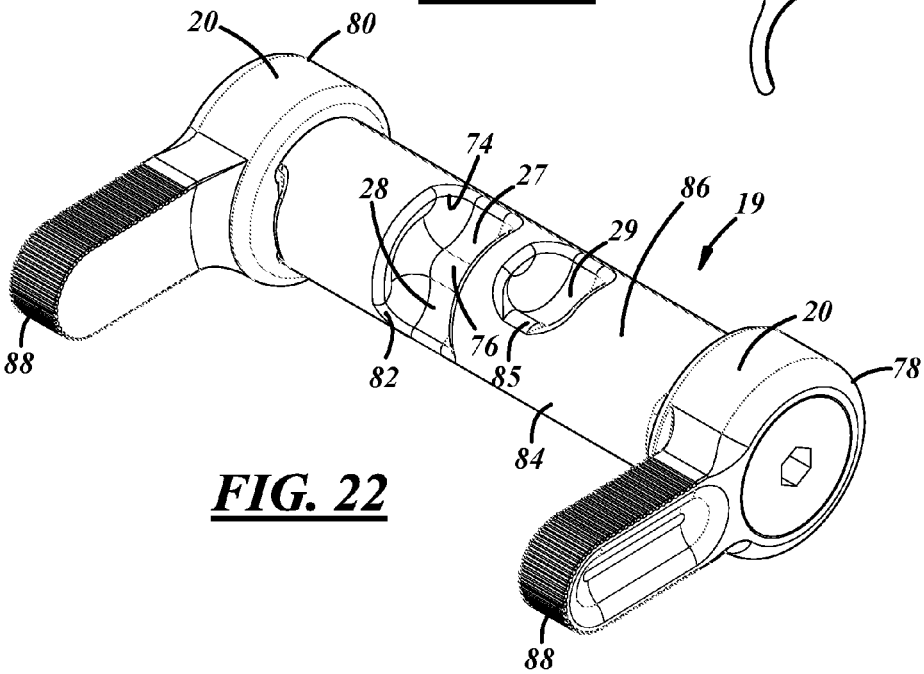
FIG. 22 is a perspective view of a portion of the safety mechanism illustrated in FIGS. 14-21.

As shown more particularly in FIGS. 19-21, the trigger mechanism 34" of crossbow 10" includes a bowstring latch 3" pivotally carried by the housing 36" at an axle 49" having a first, hook-like end 50" and a second end 52" and a DFS latch 40" that includes a stop block lever 22 carried by the housing 36" via an axle 42" and a stop block 21 having a notch 72 and being carried by the housing 36" and coupled to a biasing spring 23 which also is coupled to the housing 36". The notch 72 is sized to receive a second end 46" of the lever 22.

The operation of the trigger mechanism 34" is similar to that described above. For example, when the crossbow 10" is in the fully cocked mode (not shown), the bowstring latch 3" retains the bowstring 7 at the first end 50" on a rearward-facing surface 64". If the crossbow 10" is dry-fired (e.g., the trigger arm 4" is actuated), it may enter the partially cocked mode (FIG. 19); i.e., the bowstring 7 will not deploy (retracting to a rest position—shown in FIG. 13). Instead the stop block 21 (part of the DFS latch 40") may inhibit the rotational movement of the bowstring latch 3". In addition, the engagement of the lever 22 inhibits the lateral travel of the stop block 21. The rotational travel of the lever 22 is also limited by a stop 9" (in FIGS. 19-21, the stop 9" is illustrated as a triangular member, but could also be a pin as in previous embodiments). Thus, in a dry-fire situation, the positions of the lever 22 and the stop block 21 inhibit the actuation of the bowstring latch 3" thereby inhibiting the release of the bowstring 7.

As previously described, in the partially cocked mode, the crossbow cannot be fired. However, the bowstring 7 may be re-drawn to re-enter the fully cocked mode. In this mode, the lever 22 extends at least partially into a channel 38".

When the arrow 8 is inserted into the channel 38", the lever 22 rotates about the axle 42" engaging the notch 72 in the stop block 21 sliding the stop block 21 axially forward (consequently, compressing the biasing spring 23). Thus, by the insertion of the arrow 8, the stop block 21 no longer makes contact with the bowstring latch 3". This disengagement of the DFS latch 40" from the bowstring latch 3" leaves the crossbow 10" in a fully cocked and loaded mode (FIG. 20). And when the safety mechanism is actuated to a fire mode, the arrow may be launched or fired or released.

FIG. 21 illustrates the trigger 1" having been actuated and the trigger arm 4" working in cooperation with the bowstring latch 3" to thereby release the arrow 8. Thus, FIG. 21 illustrates the instant the bowstring latch 3" is released as the bowstring 7 moves toward its rest position.

In general, the DFS lever 22 is a rotating component having a portion located in the arrow path or channel 38" and the DFS stop block 21 is biased to lock the bowstring latch 3" in place from above the latch 3" until the arrow is inserted into the channel 38" to displace the lever 22 and, thus, the block 21 of the DFS latch 40". Accordingly, the DFS latch 40" automatically engages the bowstring latch 3" when the arrow is not in the channel 38" or is being removed from the channel 38" to prevent accidental or dry fire release of the bowstring 7.

In contrast to previous approaches, the presently disclosed mechanisms are simpler, without unnecessary or numerous latches, levers, catches, springs, and/or other components. Also, in the present disclosure, the bowstring does not release, and thus it is not necessary to catch a dry fired bowstring.

There thus has been disclosed a crossbow that fully satisfies all of the objects and aims previously set forth. The crossbow has been disclosed in conjunction with illustrative embodiments, and modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A trigger mechanism for a crossbow, comprising:

a housing having a channel for receiving an arrow;

a trigger arm carried by the housing;

a bowstring latch that retains a bowstring in a cocked position, and that is pivotally carried by the housing and engageable with the trigger arm; and a dry-fire safety (DFS) latch that is carried by the housing, and that engages the bowstring latch to retain the bowstring latch in the cocked position to inhibit bowstring release when the trigger arm is actuated without an arrow seated in the channel of the housing.

2. The trigger mechanism set forth in claim 1, wherein the DFS latch is configured such that retention by the DFS latch of the bowstring permits marginal movement of the bowstring.

3. The trigger mechanism set forth in claim 1, wherein when the arrow is moved into the housing channel, the arrow displaces the DFS latch, which, in turn, disengages the bowstring latch.

4. The trigger mechanism set forth in claim 1, wherein, in the cocked position and without an arrow, the bowstring latch retains the bowstring at a first end of the bowstring latch and engages the DFS latch at the first end, and a second end of the bowstring latch directly engages the trigger arm.

5. The trigger mechanism set forth in claim 4, wherein, in a cocked and loaded position, the bowstring latch retains the bowstring at the first end and the DFS latch is displaced from the first end, and the second end of the bowstring latch directly engages the trigger arm.

6. The trigger mechanism set forth in claim 1, wherein at least a portion of the DFS latch is directly pivotably carried by the housing.

7. The trigger mechanism set forth in claim 1, further comprising a safety mechanism, wherein the safety mechanism is at least one of carried by and axially slidable within the housing, or external to the housing and further comprising a rotatable safety spool.

8. The trigger mechanism set forth in claim 1, wherein the DFS latch is directly engageable with the bowstring latch and extends into the channel from a location above the channel.

9. The trigger mechanism set forth in claim 1, wherein the DFS latch extends into the channel such that an arrow slid along the channel toward the bowstring contacts the DFS latch and moves the DFS latch in a direction perpendicular to the channel as the arrow moves toward the bowstring.

10. The trigger mechanism set forth in claim 1, wherein the DFS latch is directly engageable with the bowstring latch and extends into the channel from a location above the channel; and wherein the DFS latch extends into the channel such that an arrow slid along the channel toward the bowstring contacts the DFS latch and moves the DFS latch.

11. The trigger mechanism set forth in claim 1, wherein the DFS latch restrains the bowstring latch so that the bowstring does not move more than 1/16 inches when the trigger arm is actuated without an arrow seated in the channel of the housing.

12. The trigger mechanism set forth in claim 1, wherein the retention by the DFS latch of the bowstring maintains continuous engagement of the bowstring with the bowstring latch when the trigger arm is actuated without an arrow seated in the channel of the housing.

13. The trigger mechanism set forth in claim 1, wherein the DFS latch engages a frontward facing side of the bowstring latch.

14. The trigger mechanism set forth in claim 1, wherein the DFS latch engages an upper portion of the bowstring latch.

15. The trigger mechanism set forth in claim 1, wherein the trigger arm has a plurality of fingers, and wherein the bowstring latch is movably engagable with one finger of the trigger arm; and the DFS extends into the channel.

16. The trigger mechanism set forth in claim 15, wherein, when the arrow is received by the channel, the DFS latch is displaced from the channel, wherein when the trigger arm is actuated, the DFS latch no longer inhibits the bowstring latch from releasing the bowstring.

17. The trigger mechanism set forth in claim 15, further comprising a safety mechanism carried within the housing, slidably engageable between a safe mode and a fire mode by engaging a second finger of the trigger arm and disengaging the second finger, respectively.

* * * * *